US005479682A

United States Patent [19]

Hendrikx et al.

[11] Patent Number: 5,479,682

[45] Date of Patent: Jan. 2, 1996

[54] CLAMP FOR PAPER SHEETS

[76] Inventors: Remigius V. Hendrikx, Mensinge 12, NL-5655 HA Eindhoven; Johanna M. A. T. Cavé-Jansen, Beekersberg 5, NL-5066 CT Moegestel (NBR), both of Netherlands

[21] Appl. No.: 256,517

[22] PCT Filed: Jan. 8, 1993

[86] PCT No.: PCT/NL93/00005

§ 371 Date: Sep. 7, 1994

§ 102(e) Date: Sep. 7, 1994

[87] PCT Pub. No.: WO93/13948

PCT Pub. Date: Jul. 22, 1993

[30] Foreign Application Priority Data

Jan. 8, 1992 [NL] Netherlands ..... 9200023

[51] Int. Cl.[6] ..... B42F 3/00

[52] U.S. Cl. ..... 24/67.11; 24/67 R; 24/67.3

[58] Field of Search ..... 24/67.11, 67 P, 24/67 R, 67.3, 67.7

[56] References Cited

U.S. PATENT DOCUMENTS

| | | | |
|---|---|---|---|
| 531,312 | 12/1894 | Heysinger | 24/67.7 |
| 1,869,032 | 7/1932 | Van Buren . | |
| 2,740,897 | 4/1956 | Fairbank | 24/67 R |
| 3,307,558 | 3/1967 | Benjamin | 24/67.7 |
| 3,310,901 | 3/1967 | Sarkisian | 24/67.7 |
| 4,241,477 | 12/1980 | Freedom et al. | 24/67.3 |
| 4,525,899 | 7/1985 | Carroll | 24/67 R |

FOREIGN PATENT DOCUMENTS

| | | | |
|---|---|---|---|
| 0826243 | 3/1938 | France | 24/67.11 |
| 512952 | 9/1939 | United Kingdom . | |

*Primary Examiner*—Victor N. Sakran
*Attorney, Agent, or Firm*—Young & Thompson

[57] ABSTRACT

Clamp having a U-shaped body (1) for inserting objects therebetween wherein one (2) of the legs is provided with a resilient lockable lip (4) for clamping the objects concerned between the lip (4) and the other leg (3) of the U-shaped body. In this arrangement, the hinge axis of the lip extends essentially at right angles to the longitudinal center line of the web (7) of the U-shaped body. As a result, the clamp extends to a smaller extent over the width of the object to be clamped and over a greater length of the object to be clamped.

7 Claims, 2 Drawing Sheets

CLAMP FOR PAPER SHEETS

FIELD OF THE INVENTION

The present invention relates to a U-shaped clamp for inserting objects between it's legs.

BACKGROUND OF THE INVENTION

Such a clamp is disclosed in U.S. Pat. No. 4,241,477. The clamp shown therein is made from a relatively rigid thick material and the lip is from a resilient relatively thin material. In the description it is indicated that those parts might be integrally formed. Engagement of the lip to the related part of the leg is realized only by resilient deformation of this lip which snaps behind a protruding part of the related leg. This engagement can be realized by engaging a tab of the resilient lip. However, such engagement may result in damage of the nails or finger of the user engaging the tab protruding from the paper clip in the position of use and a relatively considerable force will be required to disengage the resilient lip.

SUMMARY OF THE INVENTION

The object of the present invention is to avoid the above-mentioned disadvantages.

According to the present invention the U-shaped body is preferably elastically deformable such that the distance between the free locking end of the lip and the part of the one leg which can engage with it can be increased. That is to say that unlocking of the lockable lip is effected by bending the clamp, as a result of which the distance between the free end of the lip and the part of the one leg engaging therewith is increased such that unlocking is effected. Either the web of the U-shaped body of the one leg is provided with a weakened section in order to facilitate the bending. In addition, the bending may be facilitated by fitting a projection to the underside of the other leg. Consequently, the clamp has only to be pressed at both ends, which causes a bulge and moves the lockable lip out of the locked position if it is on a flat surface.

According to an advantageous embodiment of the invention, the lip forms the partial outer boundary of the one leg of the U-shaped body. Thus it is possible significantly to simplify the operation of the lockable lip while, on the other hand, the width of the clamp can be limited further.

Locking may be achieved by all methods known in the state of the art, but according to a preferred embodiment of the invention, the locking end of the lip is provided with a recessed part and the part of the one leg which can engage with it is provided with an oppositely recessed part.

Moreover, interacting fastening means, such as a tenon/mortise assembly, may be fitted on the lockable lip, on the one hand, and on the other leg, on the other hand.

The clamp described above may be provided with suspension means in order not only to fix in the clamp one or more of the objects inserted in the clamp, but also to suspend them by means of the suspension means mentioned.

BRIEF DESCRIPTION OF THE DRAWINGS

The invention will be explained in detail below with reference to the illustrative embodiment shown in the drawing, in which.

DETAILED DESCRIPTION OF THE INVENTION

Figure 1:
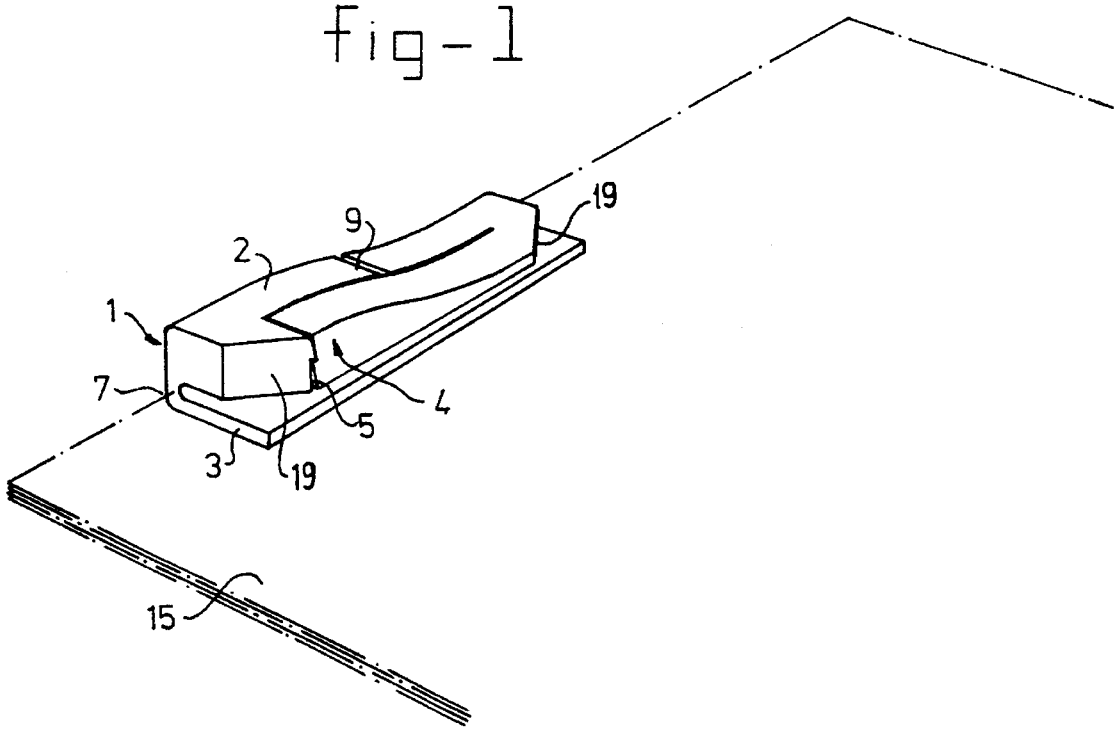
FIG. 1 shows a perspective view of the clamp according to the invention in the closed position.

The clamp according to the invention comprises a U-shaped body 1 having a web 7, a leg 2 and a further leg 3. A U-shaped insert is delimited therebetween for inserting, for example, flat paper 15. Of course, it is also possible to insert other objects in the clamp described here. The web of the U forms the stop for the objects to be inserted.

Figure 2:
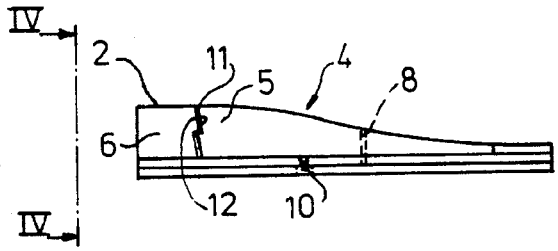
FIG. 2 shows a side view of the clamp according to the invention.

The one leg 2 is provided with a lockable lip 4, the hinge centre line of which is essentially at right angles to the longitudinal centre line of the web 7. The lockable lip 4 is provided with a free end having cam means 11. As FIG. 2 shows, cam means 11 are designed to match cam means 12 of the part 6 of the one leg 2. Body 7 and the one leg 2 are provided with grooves as a weakened section, the groove in the web 7 being indicated by 8 and the groove in the one leg 2 being indicated by 9. The lockable lip 4 is provided with a pin 10 which can slot into a corresponding aperture 13 in the other leg 3. Bevelled edges in the one leg 2 have been indicated by 19, which bevelled edges facilitate the insertion of the objects by forming a stop.

Figure 3:
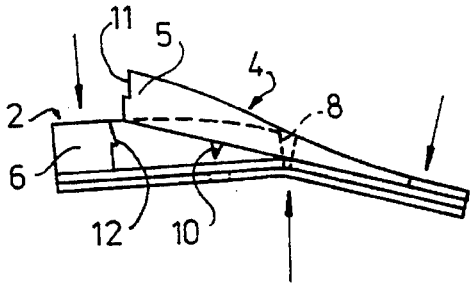
FIG. 3 shows a side view according to FIG. 2, with the clamp in the open position.

The device described above functions as follows. Starting from the position shown in FIG. 3, the objects concerned have to be inserted in the aperture delimited by the U-shaped body 1 and the free end 5 has to be moved down so that can means 11 and cam means 12 engage with each other and the situation of FIG. 2 is arrived at. In order to unlock the device again, pressure has to be applied on the ends of the legs, as indicated by the arrows. By taking the clamp between the fingers, an upward force in the center part of the clamp will occur and the cam means 11 and 12 will thus disengage. The fixing means, 10, 13 shown function for penetrating the object to be inserted and, furthermore, for retaining it. Retention is effected, on the one hand, by the clamping action of the lockable lip 4 and, on the other hand, by the fixing means. It is, of course, possible to construct the clamp without the fixing means described above.

Figure 5:
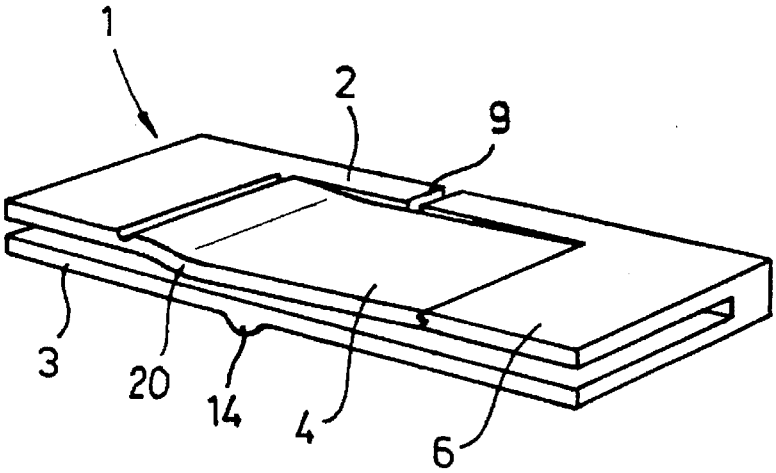
FIG. 5 shows a further embodiment of the clamp according to the invention in the closed position.
Figure 6:
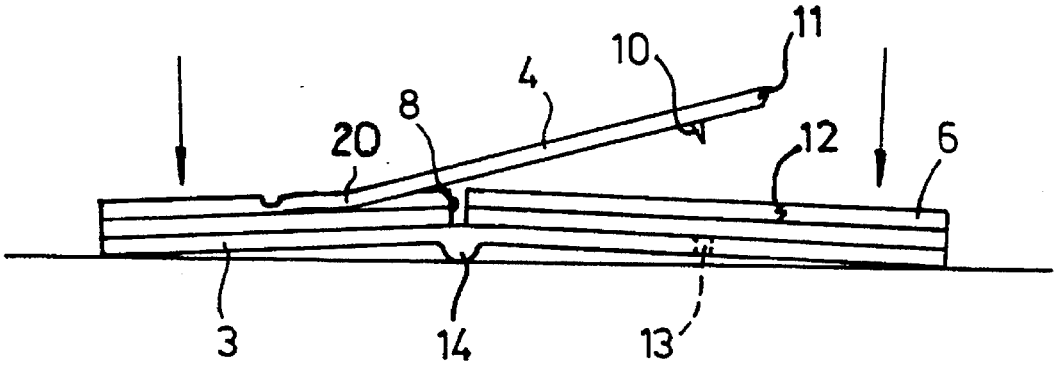
FIG. 6 shows the clamp according to FIG. 5 in the open position.

In FIGS. 5 and 6 a further embodiment of the clamp according to the invention is shown. Parts which have the same function as parts shown in one of the previous figures are denoted by the same reference numerals and they will not be discussed in any more detail.

Figure 4:
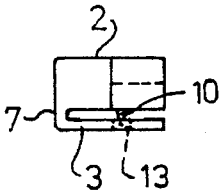
FIG. 4 shows a front view of the clamp according to the invention, along the line IV—IV in FIG. 2.

The lockable lip 4, in the embodiment according to FIGS. 4 and 5, is provided with a part 20 which extends downwards. As the lip 4 consists of resilient material, it is thus possible to provide for an adjustment to various thicknesses of the objects to be inserted in the clamp. In this embodiment, part 20 will effect the clamping action.

The other leg 3, on its underside, is provided with a cross rib 14 extending over the entire width of the clamp. As FIG. 6 shows, it is possible, by pressing on the ends when the clamp is placed on a flat surface, to unlock the lip 4.

Although the above invention has been described with reference to a preferred embodiment, it should be noted that numerous modifications may be made thereto without departing from the scope of the present application. Thus it is possible to provide means which prevent the lockable lip from being moved too far outwards, so as to prevent the needle-shaped pin 10 from being able to cause injuries.

We claim:

1. Clamp comprising a U-shaped body having two legs joined at one end by a web, said legs spaced apart a distance for inserting objects therebetween, one of the legs being provided with a resilient lockable lip for clamping the objects between said lip and the other leg of the U-shaped body, said lockable lip having a hinge axis which extends essentially at right angle to a longitudinal center line of the web of the U-shaped body, wherein the leg in which the lip is provided and at least the adjacent part of the web are provided with a groove such that the U-shaped body is elastically deformable to increase the distance between a free locking end of the lip and a part of the one leg to be engaged by the lip, and the free end of the lip engages said one leg in a locked position.

2. Clamp according to claim 1, wherein the lip forms a partial outer boundary of the one leg of the U-shaped body.

3. Clamp according to claim 1, wherein the groove extends essentially perpendicular to the longitudinal center line of the web.

4. Clamp according to claim 1, wherein the other leg is provided with a projection, essentially half-way along, at the center, on the side facing away from the other leg.

5. Clamp according to claim 1, wherein the free locking end of the lip is provided with a recessed part and the part of the one leg which can engage with it is provided with an oppositely recessed part in order to achieve the locked position.

6. Clamp according to claim 1, wherein the lip and the other leg are provided with interacting fixing means.

7. Clamp according to claim 1, wherein the lip includes a face, which faces the objects to be inserted, said face having an inwardly curved part for resiliently clamping said objects.

* * * * *